US008724836B2

(12) United States Patent
Larsen

(10) Patent No.: US 8,724,836 B2
(45) Date of Patent: May 13, 2014

(54) HEARING DEVICE WITH TWO OR MORE MICROPHONES AND TWO OR MORE RESONATORS HAVING DIFFERENT LENGTHS AND THE SAME RESONANT FREQUENCY

(75) Inventor: Martin Larsen, Smørum (DK)

(73) Assignee: Oticon A/S, Smorum (DK)

( * ) Notice: Subject to any disclaimer, the term of this patent is extended or adjusted under 35 U.S.C. 154(b) by 83 days.

(21) Appl. No.: 13/439,642

(22) Filed: Apr. 4, 2012

(65) Prior Publication Data

US 2012/0263330 A1 Oct. 18, 2012

Related U.S. Application Data

(60) Provisional application No. 61/474,768, filed on Apr. 13, 2011.

(30) Foreign Application Priority Data

Apr. 13, 2011 (EP) ..... 11162261

(51) Int. Cl.
*H04R 25/00* (2006.01)
*H04R 1/02* (2006.01)
*H04R 9/08* (2006.01)

(52) U.S. Cl.
USPC ..... 381/322; 381/338; 381/357

(58) Field of Classification Search
USPC ..... 381/322, 345, 337–338, 351, 356–357, 381/382
See application file for complete search history.

(56) References Cited

U.S. PATENT DOCUMENTS

| | | | | |
|---|---|---|---|---|
| 3,458,668 | A | 7/1969 | Hassler | |
| 4,629,833 | A * | 12/1986 | Kern et al. | 381/320 |
| 5,526,430 | A | 6/1996 | Ono et al. | |
| 5,848,172 | A | 12/1998 | Allen et al. | |
| 7,324,653 | B2 | 1/2008 | Mehr | |
| 2007/0036381 | A1 | 2/2007 | Klemenz et al. | |
| 2007/0058833 | A1 | 3/2007 | Van Halteren et al. | |
| 2008/0013770 | A1 | 1/2008 | Wu et al. | |
| 2009/0016553 | A1 | 1/2009 | Ho et al. | |

FOREIGN PATENT DOCUMENTS

| | | | |
|---|---|---|---|
| EP | 0742678 | A2 | 11/1996 |
| WO | WO 2008/015295 | A2 | 2/2008 |

* cited by examiner

*Primary Examiner* — Brian Ensey
*Assistant Examiner* — Katherine Faley
(74) *Attorney, Agent, or Firm* — Birch, Stewart, Kolasch & Birch, LLP

(57) ABSTRACT

The invention regards a hearing device with two or more microphone units each having a conduit leading from a respective sound inlet in the hearing-device housing to a respective transducer, wherein the lengths of the conduits may differ without causing a difference in the frequency characteristics of the microphone units and wherein ultrasonic frequencies may be dampened, while at the same time providing higher freedom in the physical layout of the hearing device. This is achieved in that each conduit comprises a chamber and a pipe forming a resonator, and in that the frequencies of resonance (f1, f2) of the resonators are equal.

20 Claims, 2 Drawing Sheets

HEARING DEVICE WITH TWO OR MORE MICROPHONES AND TWO OR MORE RESONATORS HAVING DIFFERENT LENGTHS AND THE SAME RESONANT FREQUENCY

CROSS REFERENCE TO RELATED APPLICATIONS

This nonprovisional application claims priority under 35 U.S.C. §119(e) to U.S. Provisional Application No. 61/474,768 filed on Apr. 13, 2011 and under 35 U.S.C. §119(a) to Patent Application No. 11162261.9 filed in Europe, on Apr. 13, 2011, all of which are hereby expressly incorporated by reference into the present application.

TECHNICAL FIELD

The present invention relates to a hearing device with two or more microphones. More specifically, the present invention relates to a hearing device such as e.g. a hearing aid or a listening device, which receives acoustic signals from a person's surroundings, modifies the acoustic signals electronically and transmits the modified acoustic signals into the person's ear or ear canal.

The invention may e.g. be useful in applications such as a hearing aid for compensating a hearing-impaired person's loss of hearing capability or a listening device for augmenting a normal-hearing person's hearing capability.

BACKGROUND ART

European patent EP 1 579 728 B1 discloses a hearing aid with two microphones, wherein output signals from both microphones are combined to provide directional microphone signals.

Combining signals from two or more microphones in a hearing device is often encountered in the prior art. A prerequisite for obtaining e.g. a good "figure-eight" directional microphone signal is that the frequency characteristics of the microphones match each other closely. However, the physical embedding of a microphone or electroacoustic transducer affects its frequency characteristic. Therefore, such transducers are typically embedded in equal physical environments within the hearing-device housing and with conduits of equal length leading from respective sound inlets in the housing to the respective transducers. Since the locations of the sound inlets are typically dictated by audiologic requirements, this puts undesired constraints on the physical layout of the hearing device.

U.S. Pat. No. 3,458,668 A discloses a hearing aid with two microphones, each with a conduit leading from the microphone to a respective opening in the hearing-aid housing. The conduits have different lengths. The amplitude of the sound signal reaching a microphone may be changed by changing the length of the respective conduits. In this configuration, the frequency characteristics of the microphones do generally not match each other.

U.S. patent application 2008/013770 A discloses a microphone array with guide tubes of different lengths each leading from a respective microphone to a respective opening in the housing. A damper is placed in the shorter ones of the guide tubes to provide equal sound signal delays between the openings and the microphones. Also in this configuration, the frequency characteristics of the microphones do generally not match each other.

International patent application WO 2004/098232 A1 discloses a hearing aid with a microphone having a first tube leading sound to the microphone. In order to prevent ultrasonic sound from reaching the microphone, a second tube is connected to the first tube near the microphone. The length of the second tube is dimensioned to have the second tube function as a quarter-wavelength resonator that dampens ultrasonic frequencies. Applying these teachings to a hearing device with two microphones would constrain the physical layout of the hearing device further.

It is an object of the present invention to provide a hearing device, which does not suffer from the above problems. It is a further object of the present invention to provide a hearing device with two or more microphone units each having a conduit leading from a respective sound inlet in the hearing-device housing to a respective transducer, wherein the lengths of the conduits may differ without causing a difference in the frequency characteristics of the microphone units and wherein ultrasonic frequencies may be dampened, while at the same time allowing a higher freedom in the physical layout of the hearing device.

DISCLOSURE OF INVENTION

These and other objects of the invention are achieved by the invention defined in the accompanying independent claims and as explained in the following description. Further objects of the invention are achieved by the embodiments defined in the dependent claims and in the detailed description of the invention.

In the present context, a "hearing device" refers to a device, such as e.g. a hearing aid or an active ear-protection device, which is configured to improve or augment the hearing capability of an individual by receiving acoustic signals from the individuals' surroundings, modifying the acoustic signals electronically and providing audible signals to at least one of the individual's ears. Such audible signals may e.g. be provided in the form of acoustic signals radiated into the individual's outer ears, acoustic signals transferred as mechanical vibrations to the individual's inner ears via the bone structure of the individual's head and/or electric signals transferred to the cochlear nerve of the individual. A "hearing system" refers to a system comprising two hearing devices to be worn at or in opposite ears of the individual. A "binaural hearing system" refers to a hearing system wherein the two hearing devices are configured to communicate with each other and to coordinate their signal processing. Hearing devices, hearing systems and binaural hearing systems may e.g. be used in compensating for a hearing-impaired person's loss of hearing capability or augmenting a normal-hearing person's hearing capability.

In the present context, a "transducer" refers to an electroacoustic transducer for converting an acoustic signal into an electric signal, e.g. a microphone.

The transducer or microphone may function according to any known transducer principle, e.g. electrodynamic, electrostatic or piezoelectric. An "active element" of a transducer refers to the element configured to receive the acoustic signal, e.g. a diaphragm.

As used herein, the singular forms "a", "an", and "the" are intended to include the plural forms as well (i.e. to have the meaning "at least one"), unless expressly stated otherwise. It will be further understood that the terms "has", "includes", "comprises", "having", "including" and/or "comprising", when used in this specification, specify the presence of stated features, integers, steps, operations, elements and/or components, but do not preclude the presence or addition of one or more other features, integers, steps, operations, elements, components and/or groups thereof. It will be understood that when an element is referred to as being "connected" or "coupled" to another element, it can be directly connected or coupled to the other element, or intervening elements may be present, unless expressly stated otherwise. As used herein, the term "and/or" includes any and all combinations of one or more of the associated listed items.

BRIEF DESCRIPTION OF THE DRAWINGS

The invention will be explained in more detail below in connection with preferred embodiments and with reference to the drawings in which.

The figures are schematic and simplified for clarity, and they just show details, which are essential to the understanding of the invention, while other details are left out. Throughout, like reference numerals are used for identical or corresponding parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

MODE(S) FOR CARRYING OUT THE INVENTION

Figure 1:
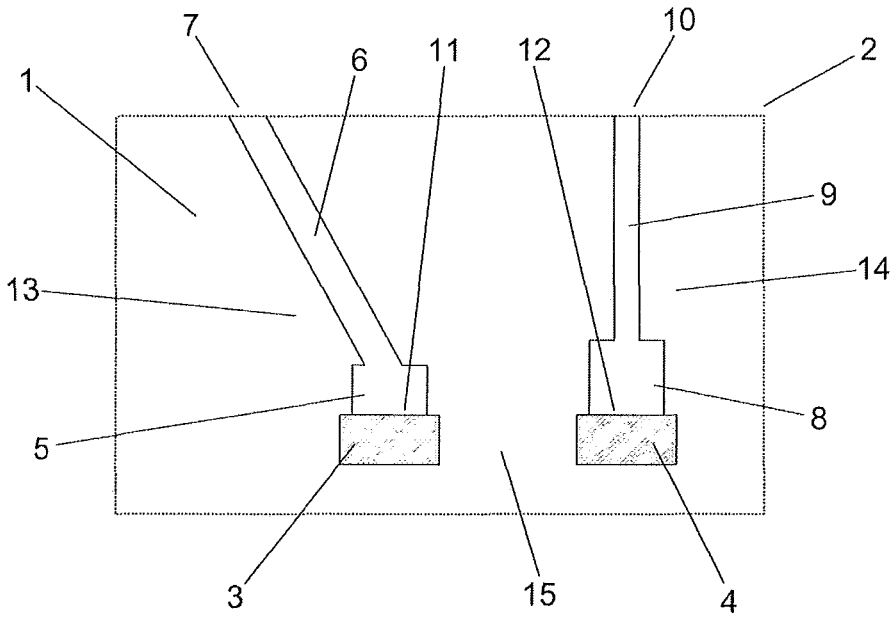
FIG. 1 shows a hearing device according to a first embodiment of the invention.

The hearing device 1 shown in FIG. 1 has a housing 2 comprising a first transducer 3, a second transducer 4, a first chamber 5, a first pipe 6 with a first sound inlet 7, a second chamber 8 and a second pipe 9 with a second sound inlet 10. The housing 2 further comprises signal processing means (not shown) configured to process output signals from the transducers 3, 4 and to provide the processed signals to the user of the hearing device in an audible format as is well known in the art. Such signal processing means may include amplifiers, analog-to-digital converters, filters, digital signal processors, digital-to-analog converters, loudspeakers, vibrators etc. as is also well known in the art. Some or all of these may be located outside the housing 2 and still form part of the hearing device 1.

The first chamber 5 and the first pipe 6 are fluidly connected to form a first conduit 5, 6 leading from the first sound inlet 7 to an active element 11 of the first transducer 3. The first conduit 5, 6 is preferably air-tight except at the first sound inlet 7, which penetrates the housing 2 so that acoustic signals from the surroundings may enter the first conduit 5, 6 through the first sound inlet 7 and reach the active element 11 of the first microphone 3 via the first conduit 5, 6. The physical dimensions of the first chamber 5 and the first pipe 6 are chosen such that the first conduit 5, 6 forms a first acoustic resonator with the first chamber 5 acting primarily as an acoustic compliance C1 and the first pipe 6 acting primarily as an acoustic mass M1. The first chamber 5 is characterised by its volume V1, and the first pipe 6 is characterised by its effective acoustic length L1 and its cross-sectional area S1.

Similarly, the second chamber 8 and the second pipe 9 are fluidly connected to form a second conduit 8, 9 leading from the second sound inlet 10 to an active element 12 of the second transducer 4. The second conduit 8, 9 is preferably air-tight except at the second sound inlet 10, which penetrates the housing 2 so that acoustic signals from the surroundings may enter the second conduit 8, 9 through the second sound inlet 10 and reach the active element 12 of the second transducer 4 via the second conduit 8, 9. The physical dimensions of the second chamber 8 and the second pipe 9 are chosen such that the second conduit 8, 9 forms a second acoustic resonator with the second chamber 8 acting primarily as an acoustic compliance C2 and the second pipe 9 acting primarily as an acoustic mass M2. The second chamber 8 is characterised by its volume V2, and the second pipe 9 is characterised by its effective acoustic length L2 and its cross-sectional area S2.

The first conduit 5, 6 and the first transducer 3 together form a first microphone unit 13. The second conduit 8, 9 and the second transducer 4 together form a second microphone unit 14. The first and second microphone units 13, 14 together form a microphone system 15.

The value of the acoustic compliance C1, C2 of each chamber 5, 8 may be computed in conventional way from:

$$C=\pi\cdot V/(\rho\cdot c^2), \tag{1}$$

where:

C is the acoustic compliance C1, C2 of the chamber 5, 8,

V is the volume V1, V2 of the chamber 5, 8,

ρ is the density of the ambient air, and c is the sound velocity in the air.

The value of the acoustic mass M1, M2 of each pipe 6, 9 may be computed in conventional way from:

$$M=L\cdot\rho/S, \tag{2}$$

where:

M is the acoustic mass M1, M2 of the pipe 6, 9,

L is the effective acoustic length L1, L2 of the pipe 6, 9, and

S is the cross-sectional area S1, S2 of the pipe 6, 9.

Computing the effective acoustic length of a pipe is well known in the art.

The frequency of resonance f1, f2 of each conduit 5, 6, 8, 9 may be computed from:

$$f=2\pi\cdot c\sqrt{(S/(L\cdot V))}, \text{ which is proportional to } 1/\sqrt{(M\cdot C)}, \tag{3}$$

where:

f is the frequency of resonance f1, f2 of the conduit 5, 6, 8, 9.

The physical dimensions of the chambers 5, 8 and the pipes 6, 9 are chosen such that the frequency of resonance f1 of the first conduit 5, 6 equals the frequency of resonance f2 of the second conduit 8, 9. This ensures that the frequency characteristics of the first and second microphone units 13, 14 are equal, given that the first and second transducers 3, 4 are identical.

The identity of the frequency characteristics of the first and second microphone units 13, 14 allow the signal processing means to process the transducer output signals to obtain improved directional characteristics of the microphone system 15. Configuring the conduits 5, 6, 8, 9 and choosing the physical dimensions of the chambers 5, 8 and the pipes 6, 9 as described above, allows the physical layout of the microphone units 13, 14 to differ substantially, e.g. to have conduits 5, 6, 8, 9 of substantially different lengths. This gives the designer of the hearing device 1 more freedom to place the transducers 3, 4 within the housing 2 without risking a deterioration of the frequency and directional characteristics of the microphone system 15.

As an example, the common frequency of resonance f1, f2 may be chosen to be 20 kHz, which is above the frequency range processed by signal processing means of typical hearing devices, i.e. above 16 kHz, and below the frequency range used by most ultrasonic appliances, i.e. below 25 kHz. By choosing the physical dimensions of the chambers 5, 8 and the pipes 6, 9 such that the frequencies of resonance f1, f2 are located above the frequency range processed by the signal processing means of the hearing device 1, it is prevented that small deviations between the acoustic properties of the conduits 5, 6, 8, 9 affect the audible signals provided to the user of the hearing device 1. By choosing the physical dimensions of the chambers 5, 8 and the pipes 6, 9 such that the frequencies of resonance f1, f2 are located below the ultrasonic frequency range, a dampening of ultrasonic frequencies is accomplished. The latter is due to the fact that each conduit 5, 6, 8, 9 functions as a low pass filter with a relatively steep roll-off above the frequency of resonance f1, f2. A dedicated quarter-wavelength resonator for dampening of ultrasonic frequencies as disclosed in WO 2004/098232 A1 may thus be omitted.

Depending on the properties of the hearing device 1, it may be desirable to place the frequencies of resonance f1, f2 above e.g. 10 kHz, 16 kHz or 20 kHz. Similarly, it may be desirable to place the frequencies of resonance f1, f2 below e.g. 30 kHz, 25 kHz or 20 kHz.

Figure 2:
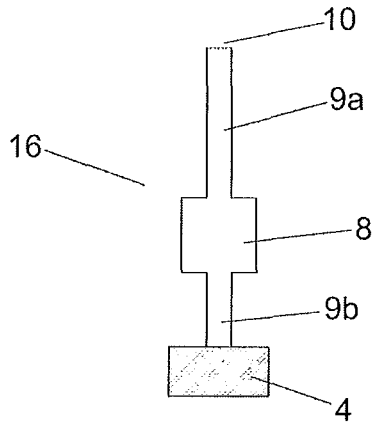
FIG. 2 shows a microphone unit of a hearing device according to a second embodiment of the invention.

Alternatively, one or more of the microphone units 13, 14 may be configured as shown in FIG. 2. The microphone unit 16 equals the second microphone unit 14 shown in FIG. 1, except that the pipe 9 comprises a first and a second pipe section 9*a*, 9*b* separated from each other and that the chamber 8 is arranged so that it fluidly connects the first and second pipe sections 9*a*, 9*b*.

The transducer 4 is arranged with its active element (not shown) in fluid connection with the second pipe section 9*b*. Thus arranging the chamber 8 at other locations along the pipe 9 does not change the acoustic properties of the conduit 8, 9, 9*a*, 9*b* as long as the total length of the pipe 9, i.e. the sum of the lengths of the pipe sections 9*a*, 9*b*, remains constant. This provides further freedom for the physical layout of the microphone system 15.

Figure 3:
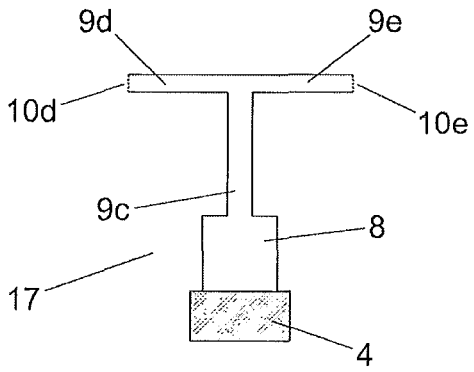
FIG. 3 shows a microphone unit of a hearing device according to a third embodiment of the invention.

Alternatively or additionally, one or more of the microphone units 13, 14 may be configured as shown in FIG. 3. The microphone unit 17 equals the second microphone unit 14 shown in FIG. 1, except that a portion of the pipe 9 is replaced by a plurality of pipe branches 9*d*, 9*e*, each fluidly connecting a respective branch inlet 10*d*, 10*e* in the housing 2 with the chamber 8 via a common pipe section 9*c*, thus forming a branched pipe 9*c*, 9*d*, 9*e*. The common pipe section 9*c* may be omitted, so that the pipe branches 9*d*, 9*e* connect directly to the chamber 8. The acoustic mass M3 of the branched pipe 9*c*, 9*d*, 9*e* may be computed from:

$$M3=M3c+1/(1/M3d+1/M3e), \quad (4)$$

where:

M3*c* is the acoustic mass of the pipe section 9*c*,

M3*d* is the acoustic mass of the pipe branch 9*d*, and

M3*e* is the acoustic mass of the pipe branch 9*e*.

The locations of the branch inlets 10*d*, 10*e* may be chosen to allow better reception of acoustical signals for hearing devices 1 located behind the ear of a user, e.g. be on opposite sides of a hearing-device housing 2. Alternatively, the locations may be chosen to provide a non-uniform directional characteristic of the acoustic signals reaching the microphone 4, e.g. on a surface of the housing 2 facing away from the user's head.

Since the location of the sound inlets 7, 10, 10*d*, 10*e* has an influence on the acoustic properties of the microphone units 13, 14, 16, 17, branching as explained above should preferably be applied to either none or all microphone units 13, 14, 16, 17 within the microphone system 15.

The relative locations of the branch inlets 10*d*, 10*e* should preferably be equal or at least similar for each of the microphone units 13, 14, 16, 17 within the microphone system 15 in order to maintain the possibility to provide good directional microphone signals by processing the microphone output signals.

The microphone system 15 may comprise three or more microphone units 13, 14, 16, 17, in which case the frequency of resonance f1, f2 should preferably be equal for all microphone units 13, 14, 16, 17 within the microphone system 15.

The microphone system 15 may be used in each of the two hearing devices 1 forming a hearing system or a binaural hearing system.

Further modifications obvious to the skilled person may be made to the disclosed device without deviating from the spirit and scope of the invention. Within this description, any such modifications are mentioned in a non-limiting way.

Some preferred embodiments have been described in the foregoing, but it should be stressed that the invention is not limited to these, but may be embodied in other ways within the subject-matter defined in the following claims. For example, the features of the described embodiments may be combined arbitrarily.

Any reference numerals and names in the claims are intended to be non-limiting for their scope.

The invention claimed is:

1. A hearing device with a housing, comprising:

a first transducer, a second transducer, a first chamber, a first pipe with a first sound inlet penetrating said housing, a second chamber, a second pipe with a second sound inlet penetrating said housing, and a signal processor configured to process output signals from said transducers and to provide audible processed signals to a user of said hearing device, said first chamber and said first pipe being fluidly connected to form a first conduit leading from said first sound inlet to said first transducer, said second chamber and said second pipe being fluidly connected to form a second conduit leading from said second sound inlet to said second transducer, wherein said first conduit forms a first acoustic resonator with said first chamber acting primarily as an acoustic compliance and said first pipe acting primarily as an acoustic mass, wherein said second conduit forms a second acoustic resonator with said second chamber acting primarily as an acoustic compliance and said second pipe acting primarily as an acoustic mass, wherein lengths of said first and second conduits differ, wherein frequencies of resonance f1, f2 of said first and second resonators are equal, wherein at least one of said conduits comprises a first pipe section and a second pipe section separated from each other, and wherein the first chamber fluidly connects the first pipe section and second pipe section of the first conduit if the at least one of said conduits comprises the first conduit, and the second chamber fluidly connects the first pipe section and second pipe section of the second conduit if the at least one of said conduits comprises the second conduit.

2. A hearing device according to claim 1, wherein said first transducer is fluidly connected directly to said first chamber, or said second transducer is fluidly connected directly to said second chamber.

3. A hearing device according to claim 1, wherein at least one of said conduits comprises a plurality of pipe branches, each of the pipe branches of the first conduit fluidly connects a respective branch inlet penetrating said housing with the first chamber when the first conduit comprises the plurality of pipe branches, and each of the pipe branches of the second conduit fluidly connects a respective branch inlet penetrating said housing with the second chamber when the second conduit comprises the plurality of pipe branches.

4. A hearing device according to claim 3,wherein a first common pipe section fluidly connects each of the pipe branches of the first conduit with the first chamber when the first conduit comprises the plurality of pipe branches, and a second common pipe section fluidly connects each of the pipe branches of the second conduit with the second chamber when the second conduit comprises the plurality of pipe branches.

5. A hearing device according to claim 3, wherein said frequencies of resonance f1, f2 are located above a frequency range processed by said signal processor.

6. A hearing device according to claim 5, wherein said frequencies of resonance f1, f2 are located above 16 kHz.

7. A hearing device according to claim 5, wherein said frequencies of resonance f1, f2 are located below an ultrasonic frequency range.

8. A hearing device according to claim 7, wherein said frequencies of resonance f1, f2 are located below 25 kHz.

9. A hearing device, comprising:

a housing;

a first transducer;

a second transducer;

a first chamber;

a first pipe with a first sound inlet penetrating said housing;

a second chamber;

a second pipe with a second sound inlet penetrating said housing; and a signal processor configured to process output signals from said transducers and to provide audible processed signals to a user of said hearing device, said first chamber and said first pipe being fluidly connected to form a first conduit leading from said first sound inlet to said first transducer, said second chamber and said second pipe being fluidly connected to form a second conduit leading from said second sound inlet to said second transducer, wherein said first conduit forms a first acoustic resonator with said first chamber acting primarily as an acoustic compliance and said first pipe acting primarily as an acoustic mass, wherein said second conduit forms a second acoustic resonator with said second chamber acting primarily as an acoustic compliance and said second pipe acting primarily as an acoustic mass, wherein lengths of said first and second conduits differ, wherein frequencies of resonance f1, f2 of said first and second resonators are equal, wherein at least one of said conduits comprises a plurality of pipe branches, wherein each of the pipe branches of the first conduit fluidly connects a respective branch inlet penetrating said housing with the first chamber when the first conduit comprises the plurality of pipe branches, and wherein each of the pipe branches of the second conduit fluidly connects a respective branch inlet penetrating said housing with the second chamber when the second conduit comprises the plurality of pipe branches.

10. A hearing device according to claim 9, wherein a first common pipe section fluidly connects each of the pipe branches of the first conduit with the first chamber when the first conduit comprises the plurality of pipe branches, and a second common pipe section fluidly connects each of the pipe branches of the second conduit with the second chamber when the second conduit comprises the plurality of pipe branches.

11. A hearing device according to claim 9, wherein said frequencies of resonance f1, f2 are located above a frequency range processed by said signal processor.

12. A hearing device according to claim 11, wherein said frequencies of resonance f1, f2 are located above 16 kHz.

13. A hearing device according to claim 9, wherein said frequencies of resonance f1,f2 are located below an ultrasonic frequency range.

14. A hearing device according to claim 13 wherein said frequencies of resonance f1, f2 are located below 25 kHz.

15. A hearing device according to claim 9, wherein said first transducer is fluidly connected directly to said first chamber, or said second transducer is fluidly connected directly to said second chamber.

16. A hearing device, comprising:

a housing;

a first transducer;

a second transducer;

a first chamber;

a first pipe with a first sound inlet penetrating said housing;

a second chamber;

a second pipe with a second sound inlet penetrating said housing; and a signal processor configured to process output signals from said transducers and to provide audible processed signals to a user of said hearing device, said first chamber and said first pipe being fluidly connected to form a first conduit leading from said first sound inlet to said first transducer, said second chamber and said second pipe being fluidly connected to form a second conduit leading from said second sound inlet to said second transducer, wherein said first conduit forms a first acoustic resonator with said first chamber acting primarily as an acoustic compliance and said first pipe acting primarily as an acoustic mass, wherein said second conduit forms a second acoustic resonator with said second chamber acting primarily as an acoustic compliance and said second pipe acting primarily as an acoustic mass, wherein lengths of said first and second conduits differ, wherein frequencies of resonance f1, f2 of said first and second resonators are equal, and wherein said frequencies of resonance f1, f2 are located above a frequency range processed by said signal processor.

17. A hearing device according to claim 6 wherein said frequencies of resonance f1, f2 are located above 16 kHz.

18. A hearing device according to claim 16, wherein said first transducer is fluidly connected directly to said first chamber, or said second transducer is fluidly connected directly to said second chamber.

19. A hearing device, comprising:

a housing;

a first transducer;

a second transducer;

a first chamber;

a first pipe with a first sound inlet penetrating said housing;

a second chamber;

a second pipe with a second sound inlet penetrating said housing; and a signal processor configured to process output signals from said transducers and to provide audible processed signals to a user of said hearing device, said first chamber and said first pipe being fluidly connected to form a first conduit leading from said first sound inlet to said first transducer, said second chamber and said second pipe being fluidly connected to form a second conduit leading from said second sound inlet to said second transducer, wherein said first conduit forms a first acoustic resonator with said first chamber acting primarily as an acoustic compliance and said first pipe acting primarily as an acoustic mass, wherein said second conduit forms a second acoustic resonator with said second chamber acting primarily as an acoustic compliance and said second pipe acting primarily as an acoustic mass, wherein lengths of said first and second conduits differ, wherein frequencies of resonance f1, f2 of said first and second resonators are equal, and wherein said frequencies of resonance f1, f2 are located below an ultrasonic frequency range.

20. A hearing device according to claim 19 wherein said frequencies of resonance f1, f2, are located below 25 kHz.

* * * * *